US009788100B2

(12) United States Patent
Essabar et al.

(10) Patent No.: US 9,788,100 B2
(45) Date of Patent: Oct. 10, 2017

(54) HEADPHONES WITH SLIDABLE LEAD ELEMENT IN EARPHONE HOUSINGS

(71) Applicant: SENNHEISER COMMUNICATIONS A/S, Ballerup (DK)

(72) Inventors: Mohamad Essabar, Ballerup (DK); Peter Vestergaard Værum, Ballerup (DK); Bo Skjoldborg, Ballerup (DK); Christian Ern, Ballerup (DK)

(73) Assignee: SENNHEISER COMMUNICATIONS A/S, Ballerup (DK)

( * ) Notice: Subject to any disclaimer, the term of this patent is extended or adjusted under 35 U.S.C. 154(b) by 206 days.

(21) Appl. No.: 14/590,421

(22) Filed: Jan. 6, 2015

(65) Prior Publication Data

US 2015/0195640 A1 Jul. 9, 2015

(30) Foreign Application Priority Data

Jan. 7, 2014 (EP) ..... 14150310

(51) Int. Cl.
*H04R 5/033* (2006.01)
*H04R 1/10* (2006.01)

(52) U.S. Cl.
CPC ..... *H04R 1/1058* (2013.01); *H04R 1/105* (2013.01); *H04R 1/1033* (2013.01); *H04R 5/0335* (2013.01)

(58) Field of Classification Search
CPC ..... H04R 1/10; H04R 1/1008; H04R 1/105; H04R 1/1058; H04R 1/1066; H04R 1/1075; H04R 1/1091
USPC ..... 381/370–383
See application file for complete search history.

(56) References Cited

U.S. PATENT DOCUMENTS

| | | | | |
|---|---|---|---|---|
| 4,065,645 | A | 12/1977 | Warner et al. | |
| 6,236,732 | B1 * | 5/2001 | Griffith | H04R 1/1008 381/370 |
| 2003/0182713 | A1 * | 10/2003 | Rolla | H04R 5/0335 2/209 |
| 2006/0147052 | A1 | 7/2006 | Wikel et al. | |
| 2008/0056525 | A1 | 3/2008 | Fujiwara et al. | |
| 2010/0046782 | A1 | 2/2010 | Ito et al. | |
| 2012/0155691 | A1 * | 6/2012 | Chen | H04R 1/06 381/380 |

* cited by examiner

*Primary Examiner* — Katherine Faley
(74) *Attorney, Agent, or Firm* — Birch, Stewart, Kolasch & Birch, LLP

(57) ABSTRACT

A headphone with over the head passage and two earphone housings is provided, with one housing attached at each end of the over the head passage at attachment areas thereof, and an electrical lead element passing between the over the head passage and the earphone housing. The over the head passage is connected at the attachment area to an earphone housing at an earphone attachment site arranged externally of the earphone housing, and the earphone housing comprise a lead element opening spaced from the earphone attachment site. The lead element opening is larger than the electrical lead element and the lead element is slidably arranged in the lead element opening.

12 Claims, 6 Drawing Sheets

HEADPHONES WITH SLIDABLE LEAD ELEMENT IN EARPHONE HOUSINGS

AREA OF THE INVENTION

A headphone is provided which comprises an over the head passage with an earphone housing at each end thereof. The headphone housing comprises a soft padding around a speaker exit corresponding to a speaker inside the housing, such that a user wearing the headphone will have both ears covered, whereby the soft padding abuts the skin or head in an area all around each ear, and the speaker may produce a high quality sound which is served directly to the ear of the user.

BACKGROUND OF THE INVENTION

Headphones of this kind needs to have adjustability in several ways in order to accommodate the various shapes of users heads. In the following the up- and down directions refers to the direction going from earphone to apex of the over the head passage. A first adjustment is commonly provided which allows the earphone housings to slid up and down with respect to the arch shaped over the head passage, and a second adjustment is usually provided which allows each headphone housing to pivot at least around a vertical axis. These adjustment systems are hampered in that the earphone housings needs to be electrically interconnected whether a wireless system is used or a wired system with a wire connection to one of the headphones is used. The electrical connections needs to connect to at least the speaker in each headphone housing. Systems are known wherein the leads pass into each housing while integrated in the various mechanical adjustment systems, and this makes the mechanical design challenging as the vulnerability of the leads must always be considered. It is also known to provide the leads separately, however here such leads are bound to both be subject to twisting and bending, and thus prone to fatigue and other failure modes.

SUMMARY OF THE INVENTION

As used herein, the singular forms "a," "an," and "the" are intended to include the plural forms as well (i.e. to have the meaning "at least one"), unless expressly stated otherwise.

It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements maybe present, unless expressly stated otherwise. Furthermore, "connected" or "coupled" as used herein may include wirelessly connected or coupled. As used herein, the term "and/or" includes any and all combinations of one or more of the associated listed items.

A headphone with over the head passage and two earphone housings is provided, wherein one earphone housing is attached at each end of the over the head passage at attachment areas of the over the head passage. An electrical lead element which passes between the over the head passage and the earphone housing is provided and the over the head passage is connected at the attachment area to the earphone housing at an earphone attachment site arranged externally of the earphone housing. By the earphone housing further comprising a lead element opening spaced from the earphone attachment site and the lead element opening being larger than the electrical lead element and the lead element further being slidably arranged in the lead element opening a headphone is provided, wherein the mechanical and electrical connections between the over the head part and the earphone housing part may be provided independently of each other, while further the lead element may remain straight or un-bend in the area between the over the head passage and the earphone housing. A lead, which in the area where it is visible and outside the over the head part and outside of the earphone housing and not subject to bending, will be less prone to being damaged and will not be entangled with the users hair. Thus it may be produced from materials which are more mundane and the design of this lead part becomes less challenging.

Inside the earphone housing a curled up part of lead parts may be provided to accommodate the sliding of the lead element in and out of the earphone housing.

Preferably the lead element opening is provided in an upper part of the earphone housing, and here this upper part is defined by being adjacent to the over the had passage. Thus when the earphone housing is moved slidingly up and down with respect to the over the head passage, the lead element may readily slide in and out of the earphone housing.

The lead elements passes from the lead element opening in the earphone housing and into the over the head passage at an entry point thereof above the attachment area.

The lead element opening in the earphone housing may be provided above an open space inside the earphone housing. This space is dimensioned to accommodate a certain length of lead element and preferably this length is at least commensurate with the maximum sliding length of the attachment area of the over the head passage. The sliding length is the distance, which the earphone may travel or slide with respect to the attachment areas. In this way it is ensured, that the lead element may at any time during sliding of the earphone find space within the earphone housing.

The lead element may be bendable, and a pivotal link may be provided and located between the entry point and the attachment areas of the over the head passage to allow the assembly of earphone housing and attachment area to pivot with respect to the over the head passage. With this pivotal movement the two earphone housings may be folded inwardly in order to form a very compact element, which is convenient for storage and transportation.

The earphone attachment site may comprise a sliding element which is arranged to slide along the attachment area of the over the head passage. The sliding element and earphone housing may thus slide in unison with regards the he over the head passage, and this allows for an expedient adjustment of the earphone housings with respect to a user's ears.

The attachment area may comprises a rectangular window with respective upper and lower short parallel opposed sides and respective long parallel opposed sides interconnecting the short parallel opposed sides. The rectangular window comprise an inner side adapted to face the head and an outer side adapted to face away from the head of a user when the headphone is used, and the sliding element comprise an inner pressure plate and an outer pressure plate respectively which urges friction control pads towards the long parallel sides of the rectangular window.

The inner pressure plate may comprise an opening having a rim shaped as a spherical lip and the outer pressure plate may comprise a spherically shaped indent opposite the spherical lip. Preferably a ball element having ball-shaped surface parts corresponding to the spherical indent and to the spherical lip and a shaft attached to the ball shaped surface parts is arranged between the pressure plates with the shaft extending through the opening in the inner pressure plate. The earphone hosing is then attached to this shaft. The pressure plates are thus provided to both supply the friction forces with respect to the sliding of the sliding elements and also provide the friction between the headphone housing and the sliding elements for the pivotal movement thereof. Preferably the two pressure plates are urged towards each other by means of normal screw connections well known in the art.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF A PREFERRED EMBODIMENT

Figure 1:
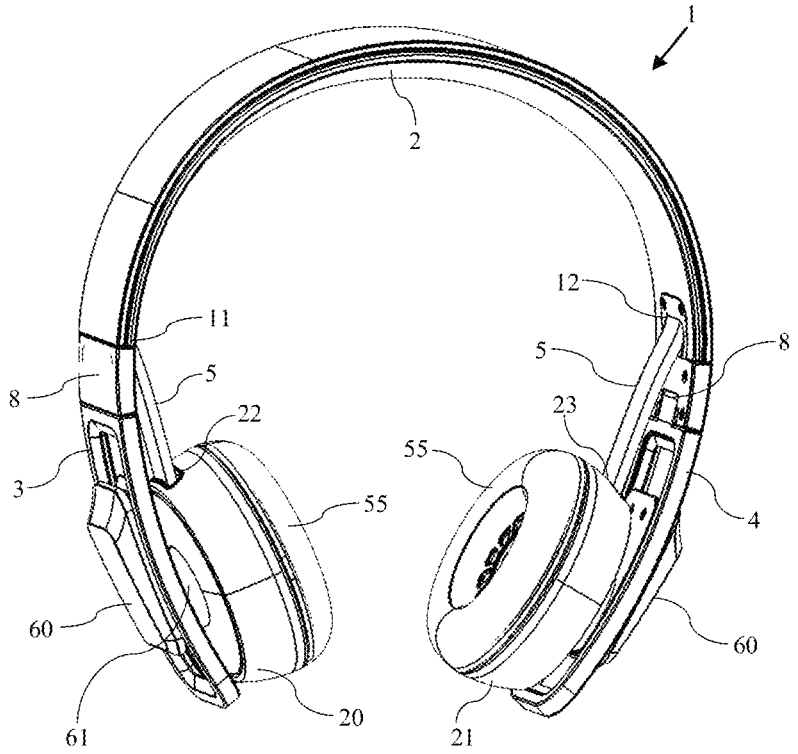
FIG. 1 shows schematic view of a headphone according to the invention.

FIG. 1 shows schematic view of a headphone 1 according to the invention. The headphone comprises an over the head passage 2 and two earphone housings 20, 21. One earphone housing 20, 21 is attached at each end of the over the head passage 2 at attachment areas 3,4 thereof. An electrical lead element 5 connects the inside electrical elements of one earphone housing 20 with the inside electrical elements of the other earphone housing 21. The electrical elements are not disclosed in any detail, as they are provided in the same manner as in the prior art, and comprise at least a speaker 10 in each housing 20,21. If the headphone is made for wired connection, an electrical input terminal 13 in at least the one earphone housing 20 is provided, and if wireless connections are part of the device, a battery (not shown) and antenna facilities (not shown) are part of the device as well known in the art. The over the head passage 2 is connected at its attachments areas 3, 4 to the earphone housings 20, 21 at earphone attachment sites 6,7 arranged externally of the earphone housings 20, 21. The earphone housings 20,21 each comprises a lead element opening 22, 23 spaced from the earphone attachment sites 6,7 and the lead element openings 22, 23 are larger than the electrical lead elements 5 and thereby the lead element 5 is arranged to slide in the lead element openings 22, 23 at each earphone housing 20,21. At the attachment areas 3,4 the earphone housings 20,21 are attached in a way which allows the earphone housings to slide up and down with respect to the over the head passage 2, in order for the user to be able to adjust the earphone housing positions to his head size and ear positions. When doing this the lead element 5 at each earphone housing 20,21 may slide in and out of the lead element openings 22,23.

From FIG. 1 it can be seen that the lead element openings 22, 23 are provided in an upper part of the earphone housings 20,21 whereby this upper part is defined by being adjacent to the over the head passage 2. When the headphone device is placed on a users head with the earphone housings covering the users ears, the over the head passage will pass over the head and also the over the head passage 2 comprise a spring element (not shown) which will urge the two earphone housings towards each other, and this will ensure that the headphone will stay attached to the users head, also during head movements. The spring element is well known in the art, and is not shown or described in further detail.

The lead element 5 passes from the lead element openings 22,23 in the earphone housings 20,21 and into the over the head passage 2 at an entry point 11,12 thereof above the attachment areas 3,4. The over the head passage 2 is a compound element with the spring and the lead and possibly decorative casing elements, whereby the leads 5 will be enclosed inside this compound element for the passage over the head of the user.

Figure 2:
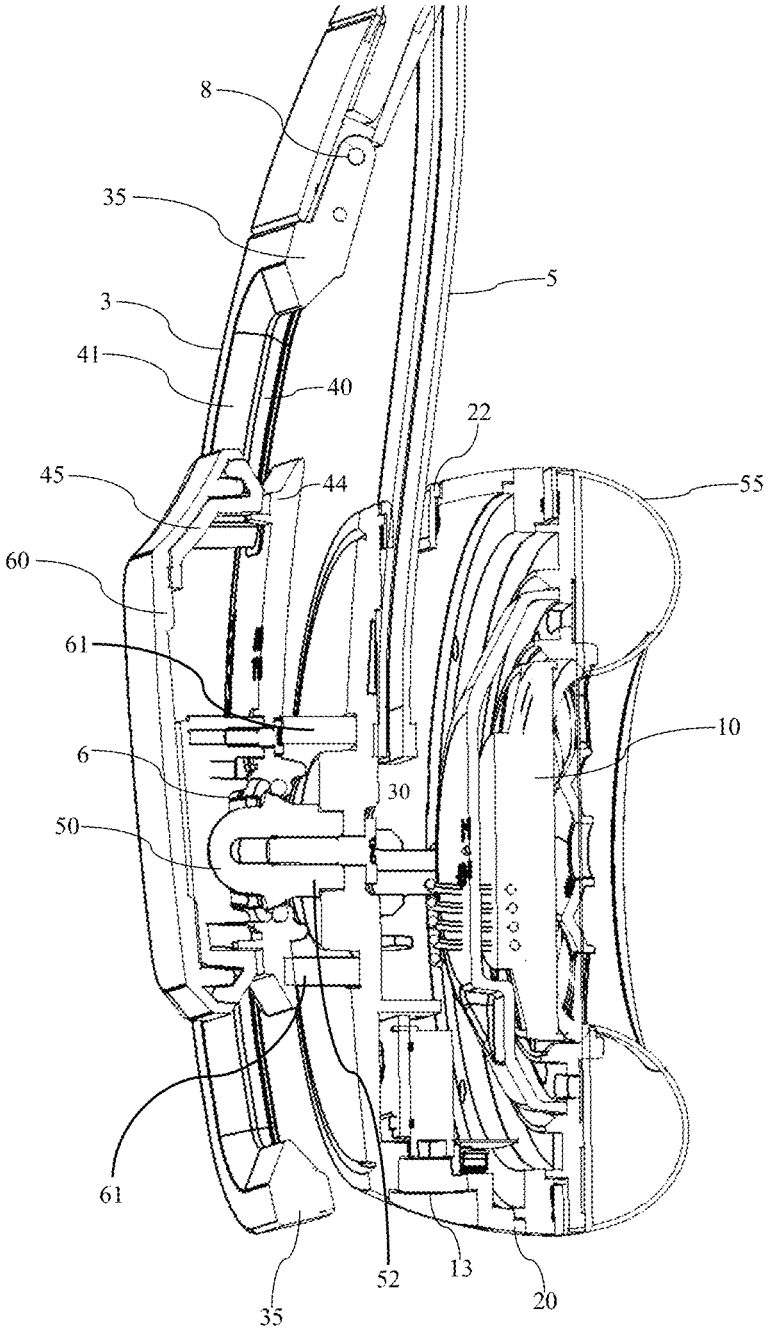
FIG. 2 shows a sectional view through a 3*d* projection view of an earphone.

FIG. 2 shows a sectional view through a 3 *d* projection view of an earphone housing 20. The lead element opening 22 in the earphone housings 20 is provided above an open space 30 inside the earphone housing. This space 30 is dimensioned to accept a certain length of lead element 5, such that when the earphone housing is caused to slide up and down along the attachment area 3, the lead element 5 may move in and out of this open space 30. The lead element 5 is flexible, yet resilient enough to stay straight during motion in and out of the earphone housing 20 through the opening 22, and the opening fits the contour of the lead element 5 without pinching the lead element. Never the less, the lead element 5 is bendable so that some pivotal motion of the earphone housings 20, 21 with respect to the attachment areas 3,4 may take place and further, a pivotal link 8,9 may be provided and located between the entry point 11,12 and the attachment areas 3,4 of the over the head passage 2 to allow the assembly of earphone housings 20,21 and attachment areas 3,4 to pivot with respect to the over the head passage 2. The link 8,9 allows the assembly of earphone housing 20 and attachment area 3 at one side to be pivoted inward and be folded up against the inside of the over the head passage 2, and the earphone housing 21 and attachment area 4 of the other side may be similarly folded, and thus a very compact headphone unit may be provided for storage purposes.

Figure 3:
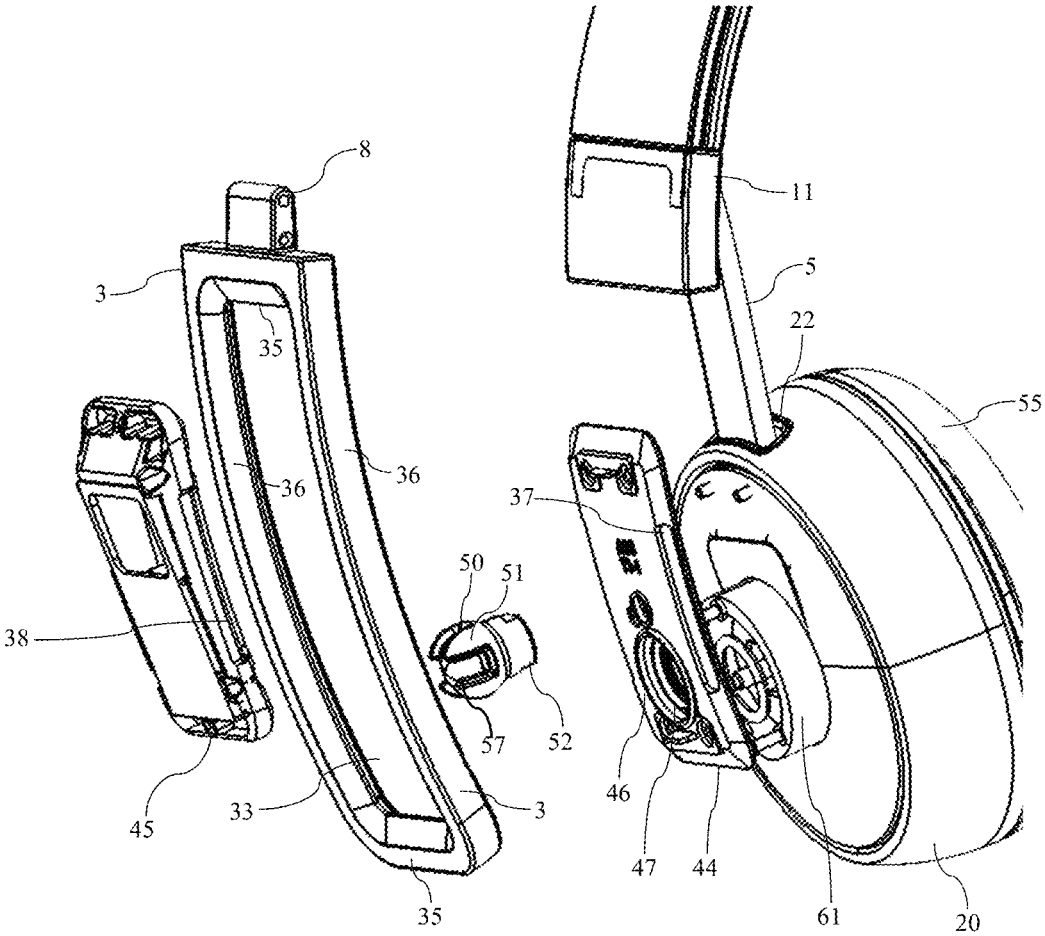
FIG. 3 shows the earphone attachment sites in exploded view.
Figure 5:
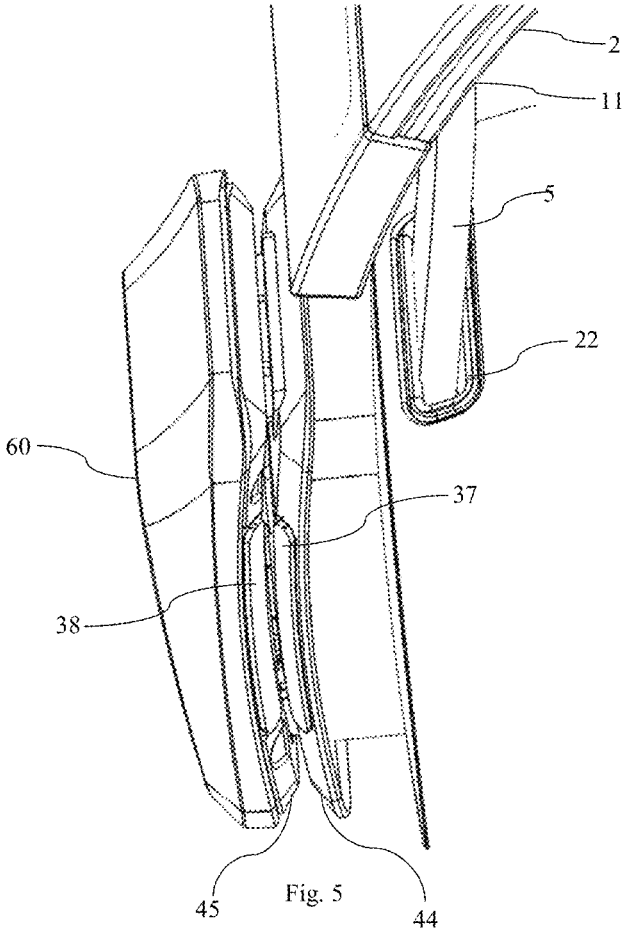
FIG. 5 shows a schematic 3*d* view with the attachment area element not shown.
Figure 6:
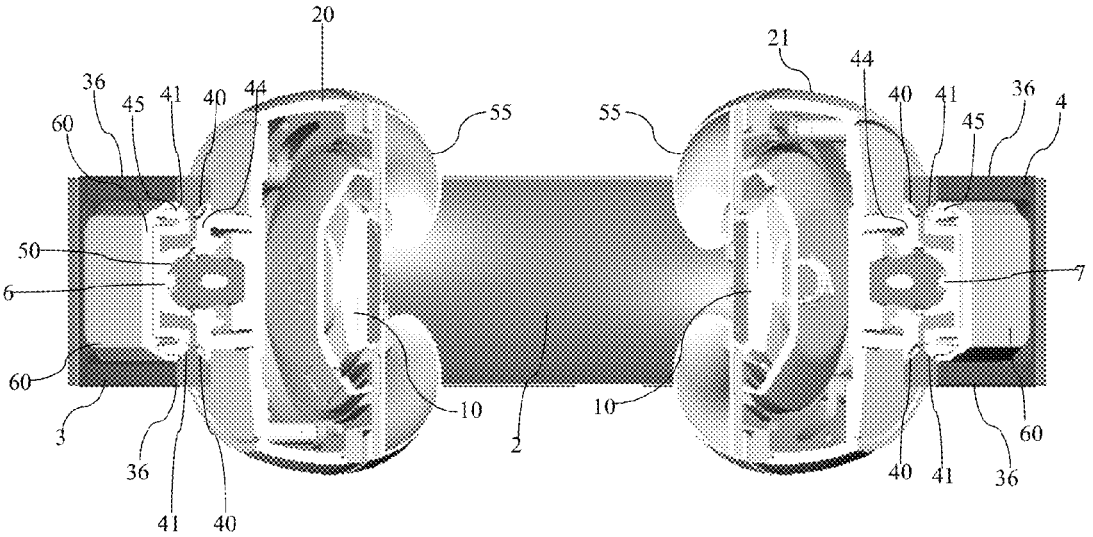
FIGS. 6 and 7 shows a sectional view from below through the connection between earphone housing and over the head passage of a headphone
Figure 7:
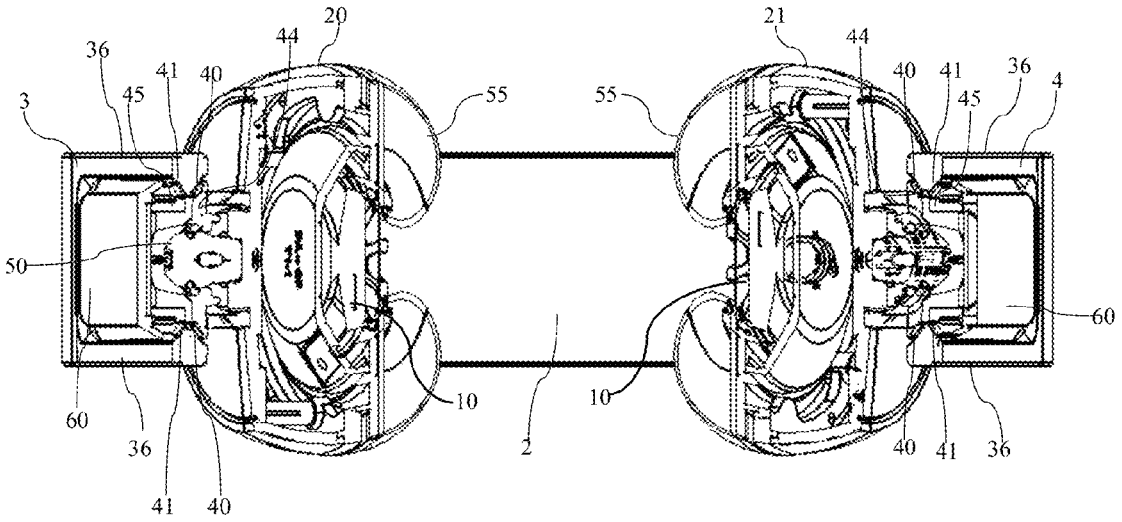
Figure 8:
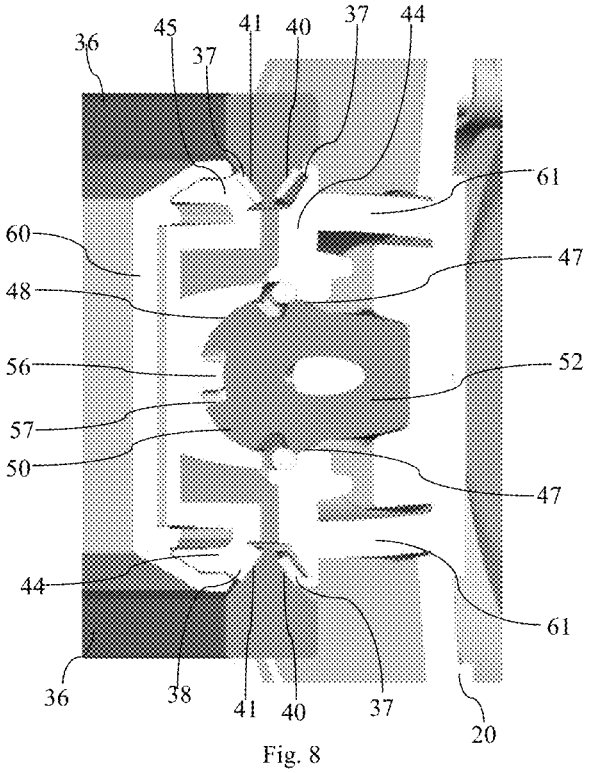
FIGS. 8 and 9 shows an enlarged view of a part of FIGS. 6 and 7 respectively, The figures are schematic and simplified for clarity, and they just show details which are essential to the understanding of the invention, while other details are left out. Throughout, the same reference numerals are used for identical or corresponding parts.
Figure 9:
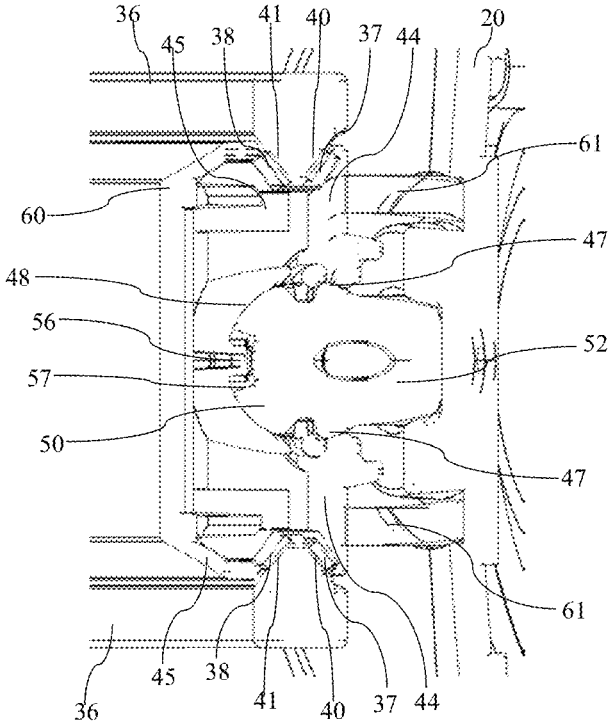

FIG. 3 shows the earphone attachment sites in exploded view. Pressure plates 44, 45 are arranged to slide along the attachment areas 3 of the over the head passage 2. As seen in FIGS. 1, 2 and 5 a decorative cover element 60 may be attached externally to pressure plate 45, but this plate has mainly decorative purposes and is not mentioned further, and also this decorative cover element 60 is not shown in FIG. 3. The attachment area 3 comprises a rectangular window 33 with respective upper and lower short parallel opposed frame parts 35 and respective long parallel opposed frame parts 36 interconnecting the short parallel opposed sides 35. The pivotal link 8 with the over the head passage 1 is provided adjacent to an upper one of the short opposed frame parts 35. The pressure plates 44, 45 abut each one of the long parallel opposed frame parts 36. Friction control pads 37,38 may be installed between the pressure plates 44, 45 and the long opposed frame parts 36, to ensure that a constant friction force is provided throughout the living time of the headphone 1. As is clear from FIG. 3 the window 33 is slightly curved so that the inner side facing the head of a user is concave, and the outer side facing away from the user is convex. FIG. 5 shows a schematic 3 d view with the attachment area 3, and frame parts 35,36 not shown, and in this particular view, one set of the friction control pads 37, 38 are clearly visible. FIGS. 6 and 7 show a sectional view from below through the connection between earphone housing and over the head passage of a headphone. FIG. 7 is a line drawing and FIG. 6 comprises computer generated shadow effects to better mark curvatures of surfaces. The relative positions of the pressure plates 44, 45; the ball 50 and spherical surfaces 47, 48 and the long opposed frame parts 36 of the rectangular window of the attachment area are disclosed. FIGS. 8 and 9 shows an enlarged view of a part of FIGS. 6 and 7 respectively, and a set of pads 37,38 are provided at each of the two opposed long frame parts 36 of the rectangular window 33 and seen in these views. As seen in FIG. 3 they are provided to extend along the frame parts 36 and abut two opposed surfaces 40,41 of the two opposed frame parts 36. The two surfaces 40, 41 are angled inward and intersect forming a v-shape best seen in FIGS. 2, 8 and 9.

The pressure plates 44,45 each comprises an inner pressure plate 44 and an outer pressure plate 45 and they are arranged to urge the friction control pads 37,38 towards the long parallel frame parts 36 of the rectangular window 3 from each side of the v-shaped intersection of the two surfaces 40,41.

Figure 4:
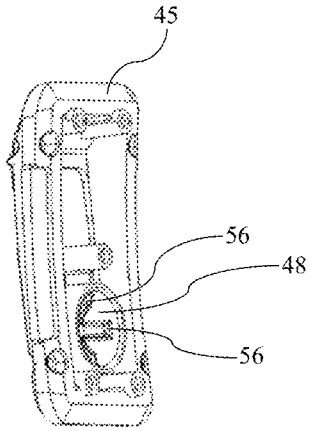
FIG. 4 shows the outer pressure plate in a 3*d* projection.

The inner pressure plate 44 comprises an opening 46 having a rim shaped as a spherical lip 47 and the outer pressure plate 45 comprises a spherically shaped indent 48 opposite the spherical lip 47. FIG. 4 shows the outer pressure plate in a 3*d* projection, and here the indent 48 is seen. In the exploded view of FIG. 3 a ball element 50 is also visible, which has ball-shaped surface parts 51 corresponding to the spherical indent 48 and the spherical lip 47 and a shaft 52 is attached to ball element 50. The ball shaped element 50 is arranged between the outer pressure plate 45 and the inner pressure plate 44 with the shaft 52 extending through the opening 46 in the inner pressure plate 44. As seen in FIGS. 8 and 9 the earphone hosing 20 is attached to the shaft 52. The attachment of the earphone housing 20 to the sliding element through the ball shaped element 50 allows some movement of the earphone housing 20 with respect to the sliding element, whereby it may pivot in any direction to provide a nice close fit between the surrounding of a users ears and softly yielding earphone cushions 55.

Provisions have been made to prevent the ball element 50 from moving too far in any direction. In FIGS. 8 and 9 this is seen as a ridge 56 shaped in the spherical surface of the indent 48 corresponding to furrows 57 provided in the surface of the ball element 50. The furrow 57 and ridge 56 are provided as a cross as seen in FIG. 4 and in FIG. 3 and by making the furrow 57 somewhat wider than the ridge 56 the relative movement between the ball element 50 and the spherical indent 48 may be controlled to not exceed predefined limits. Both rotational movement and pivotal movements are limited by this construction.

As seen in FIG. 3 and FIGS. 6-8 an absorber 61 is provided between the headphone housing 20 and the pressure plate 45, which is made of a flexible yielding material such as soft polymer or rubber. The absorber 61 works as a damper and provides for nice and smooth movements of the headphone in response to the shape of the users head when the headphones are put on by a particular user.

1 headphone
2 Over the head passage
3,4 Attachment areas
5 Lead element
6,7 Attachment sites
8,9 Pivotal link
10 Speaker
11,12 Entry point
13 Electrical input terminal
20,21 Earphone housings
22,23 Lead element opening
33 Rectangular window
35 Short opposed frame parts
36 Long opposed frame parts
37,38 Friction control pads
40,41 Opposed surfaces
44 Inner pressure plate
45 Outer pressure plate
46 Inner pressure plate opening
47 Spherical lip
48 spherically shaped indent
50 Ball shaped element
51 Spherical surface parts
52 Shaft
55 Earphone cushions
56 Ridge
57 Furrow
60 Decorative cover element
61 Absorber

The invention claimed is:

1. Headphone with over-the-head passage and two earphone housings, one housing of the two earphone housings attached at each end of the over-the-head passage at attachment areas thereof, and an electrical lead element passing between the over-the-head passage and each of the two earphone housings, wherein the over the head passage is connected on each end at a respective attachment area of the attachment areas to a respective earphone housing of the two earphone housings at an earphone attachment site arranged externally of the respective earphone housing, and whereby each earphone housing comprises a lead element opening spaced from the earphone attachment site whereby the lead element opening is larger than the electrical lead element and the lead element is slidably arranged to slide in the lead element opening when a user of the headphone adjusts the position of each earphone housing, wherein the earphone attachment site comprises a sliding element which is arranged to slide along the respective attachment area of the over-the-head passage, each attachment area comprises a rectangular window with respective upper and a lower short parallel opposed frame parts and respective long parallel opposed frame parts interconnecting the short parallel opposed frame parts and wherein the rectangular window comprises an inner side adapted to face the head and an outer side adapted to face away from the head of the user when the headphone is used, and the sliding element comprises an inner pressure plate and an outer pressure plate respectively which urge friction control pads towards the long parallel frame parts of the rectangular window.

2. Headphone with over the head passage as claimed in claim 1, wherein the lead element opening is provided in an upper part of each earphone housing, whereby this upper part is defined by being adjacent to the over the head passage.

3. Headphone with over the head passage as claimed in claim 2, wherein the lead element passes from the lead element opening in each earphone housing and into the over the head passage at an entry point thereof above each attachment area.

4. Headphone with over the head passage as claimed in claim 3, wherein the lead element opening in each earphone housing is provided above an open space inside each earphone housing dimensioned to accommodate a certain length of lead element, whereby this length is at least commensurate with a length of the respective attachment area of the over the head passage.

5. Headphone over the head passage as claimed in claim 4, wherein the lead element is flexible, yet resilient enough to stay straight during motion in and out of each earphone housing through the opening, and the opening fits the contour of the lead element without pinching the lead.

6. Headphone with over the head passage as claimed in claim 3, wherein the lead element is bendable, and wherein a pivotal link is provided and located between the entry point and the attachment areas of the over the head passage to allow the assembly of each earphone housing and each attachment area to pivot with respect to the over the head passage.

7. Headphone over the head passage as claimed in claim 6, wherein the lead element is flexible, yet resilient enough to stay straight during motion in and out of each earphone housing through the opening, and the opening fits the contour of the lead element without pinching the lead.

8. Headphone over the head passage as claimed in claim 3, wherein the lead element is flexible, yet resilient enough to stay straight during motion in and out of each earphone housing through the opening, and the opening fits the contour of the lead element without pinching the lead.

9. Headphone over the head passage as claimed in claim 2, wherein the lead element is flexible, yet resilient enough to stay straight during motion in and out of each earphone housing through the opening, and the opening fits the contour of the lead element without pinching the lead.

10. Headphone with over the head passage as claimed in claim 1, wherein the inner pressure plate comprises an opening having a rim shaped as a spherical lip and the outer pressure plate comprises a spherically shaped indent opposite the spherical lip, and wherein a ball element having ball-shaped surface parts corresponding to the spherical indent and to the spherical lip and a shaft attached to the ball shaped surface parts is arranged between the pressure plates with the shaft extending through the opening in the inner pressure plate, whereby the respective earphone housing is attached to this shaft.

11. Headphone over the head passage as claimed in claim 10, wherein the lead element is flexible, yet resilient enough to stay straight during motion in and out of each earphone housing through the opening, and the opening fits the contour of the lead element without pinching the lead.

12. Headphone over the head passage as claimed in claim 1, wherein the lead element is flexible, yet resilient enough to stay straight during motion in and out of each earphone housing through the opening, and the opening fits the contour of the lead element without pinching the lead.

* * * * *